US009560431B1

(12) United States Patent
Lilly

(10) Patent No.: US 9,560,431 B1
(45) Date of Patent: Jan. 31, 2017

(54) DIGITAL AUDIO BEVERAGE HOLDER

(71) Applicant: Kirk W. Lilly, Mesa, AZ (US)

(72) Inventor: Kirk W. Lilly, Mesa, AZ (US)

( * ) Notice: Subject to any disclaimer, the term of this patent is extended or adjusted under 35 U.S.C. 154(b) by 0 days.

(21) Appl. No.: 15/044,052

(22) Filed: Feb. 15, 2016

(51) Int. Cl.

| | |
|---|---|
| ***H04R 1/02*** | (2006.01) |
| ***H04R 3/00*** | (2006.01) |
| ***H04R 1/08*** | (2006.01) |
| ***A47G 23/02*** | (2006.01) |

(52) U.S. Cl.
CPC ..... *H04R 1/028* (2013.01); *A47G 23/0216* (2013.01); *H04R 1/08* (2013.01); *H04R 3/00* (2013.01); *H04R 2420/07* (2013.01)

(58) Field of Classification Search
CPC ..... B65D 25/20; B65D 25/28; B65D 51/245; A47G 19/2227; A47G 23/02; A47G 19/22; G01F 17/00; F16M 13/02; F25D 31/007
USPC ..... 340/603; 455/66.1, 90.3; 220/592.17
See application file for complete search history.

(56) References Cited

U.S. PATENT DOCUMENTS

| | | | | |
|---|---|---|---|---|
| 3,541,452 | A | 11/1970 | Disesa et al. | |
| 4,279,342 | A | 7/1981 | Van Pelt | |
| 4,571,740 | A | 2/1986 | Kirby et al. | |
| 4,700,395 | A | 10/1987 | Long | |
| 4,792,994 | A | 12/1988 | Aylward | |
| 5,070,539 | A | 12/1991 | Cheng | |
| 6,104,292 | A | 8/2000 | Romborn et al. | |
| 6,140,932 | A | 10/2000 | Frank et al. | |
| 6,778,813 | B1 * | 8/2004 | Lilly | A47G 19/2227 220/737 |
| 7,434,860 | B2 | 10/2008 | Chen | |
| 7,570,918 | B2 | 8/2009 | Chen | |
| 7,604,211 | B2 | 10/2009 | Moore | |
| 7,914,165 | B2 | 3/2011 | Bertken | |
| 8,145,821 | B2 | 3/2012 | Mead et al. | |
| 8,157,097 | B2 | 4/2012 | Hertz et al. | |
| 8,157,098 | B2 | 4/2012 | Hertz et al. | |
| 8,240,631 | B2 | 8/2012 | Schrock et al. | |
| 8,558,715 | B2 | 10/2013 | Lien et al. | |
| 8,866,630 | B2 | 10/2014 | Lien et al. | |
| 9,193,503 | B2 * | 11/2015 | White | B65D 25/20 |
| 2001/0041945 | A1 | 11/2001 | Lo | |
| 2006/0191812 | A1 | 8/2006 | Oudekerk | |

(Continued)

FOREIGN PATENT DOCUMENTS

| | | | |
|---|---|---|---|
| AU | WO 2011100783 A1 * | 8/2011 | A47G 23/0216 |
| CN | 103989433 | 8/2011 | |

(Continued)

*Primary Examiner* — Mohammad Islam
(74) *Attorney, Agent, or Firm* — Mark V. Loen

(57) ABSTRACT

The embodied invention relates to an audio system-drink holder assembly, and, in particular, to an audio system/drink holder assembly where an audio system is an integral part of the assembly and encompasses a drink holder. The drink holder is designed to take a variety of drink sizes and securely hold them in place as well as providing insulation for a hot (or cold) beverage temperature.
The embodied invention also includes an AM/FM radio with an embedded antenna, a music player, connection to an external Bluetooth device, speakers connected to a digital audio control system, a microphone for recording messages and providing control commands, a user interface for control and for display, an electronic clock with alarm, a rechargeable battery pack with charging cord, and weather reporting.

8 Claims, 8 Drawing Sheets

(56) References Cited

U.S. PATENT DOCUMENTS

| | | | | |
|---|---|---|---|---|
| 2007/0042709 | A1 | 2/2007 | Krieger et al. | |
| 2007/0060017 | A1 | 3/2007 | Klusmeyer | |
| 2007/0111700 | A1 | 5/2007 | Chen | |
| 2007/0161325 | A1 | 7/2007 | Brooks | |
| 2007/0262600 | A1 | 11/2007 | Chen | |
| 2007/0281619 | A1 | 12/2007 | Chen | |
| 2007/0281659 | A1 | 12/2007 | Chen | |
| 2008/0035827 | A1 | 2/2008 | Clores | |
| 2008/0042021 | A1 | 2/2008 | Moore | |
| 2008/0084795 | A1 | 4/2008 | Hertz | |
| 2008/0086227 | A1 | 4/2008 | Hertz et al. | |
| 2009/0080180 | A1 | 3/2009 | Bertken | |
| 2009/0292851 | A1 | 11/2009 | Mead et al. | |
| 2010/0308092 | A1 | 12/2010 | Schrock et al. | |
| 2011/0050431 | A1* | 3/2011 | Hood | A47G 19/2227 340/603 |
| 2011/0114647 | A1* | 5/2011 | Hallberg | A47G 19/2227 220/592.17 |
| 2012/0000102 | A1* | 1/2012 | Bruce | A47C 1/121 40/320 |
| 2012/0074030 | A1 | 3/2012 | Butler | |
| 2014/0094126 | A1* | 4/2014 | Sandy | B65D 23/00 455/66.1 |
| 2014/0174964 | A1 | 6/2014 | White et al. | |
| 2014/0246431 | A1* | 9/2014 | Lipson | B65D 51/24 220/212 |
| 2015/0083732 | A1* | 3/2015 | Phipps | A47G 19/02 220/574.1 |
| 2015/0233631 | A1* | 8/2015 | Shuntich | F25D 31/007 62/64 |
| 2015/0359364 | A1* | 12/2015 | Sweeney | B65D 51/1644 206/459.1 |

FOREIGN PATENT DOCUMENTS

| | | | | |
|---|---|---|---|---|
| EP | 2241224 | A2 | 10/2010 | |
| WO | 2011100783 | | 8/2011 | |
| WO | WO 2013006542 | A1 * | 1/2013 | A63B 23/16 |

* cited by examiner

DIGITAL AUDIO BEVERAGE HOLDER

CROSS REFERENCE TO RELATED APPLICATIONS

Not applicable.

STATEMENT REGARDING FEDERALLY SPONSORED RESEARCH OR DEVELOPMENT

Not applicable.

REFERENCE TO SEQUENCE LISTING, A TABLE, OR COMPUTER PROGRAM LISTING

Not applicable.

BACKGROUND OF THE INVENTION (1) Field of the Invention

The embodied invention is an audio system that is incorporated into a convenient beverage holder structure designed for a variety of beverage containers. An important number of convenient audio control features are incorporated, as well as a number of features that are incorporated into a small, compact device.

(2) Description of Related Art

Others have worked in the field of beverage holders which incorporate audio systems. For example, U.S. Pat. No. 6,104,292 is an example of a baby bottle holder which incorporates a transmitter to server as a baby monitor. Although an audio system is included, it is designed to playback pre-recorded sounds.

Another example is U.S. Pat. No. 6,140,932 which is a pictorially adorned drinking container that incorporates an audio playback from a recording which is related to the image on the drinking container. Although somewhat occasionally useful for commemorating an important event, it has marginal use for anything other than that purpose.

Another example is U.S. Pat. No. 7,914,165 which is generally designed for the bottled water market, the sports market, and the first aid market. It has features that provide for a radio such as a weather channel (NOAA), storage for first aid items or a flashlight, and a beverage container. Although useful for these markets, it is less useful for an office setting or a small personal space.

It is desirable to have a way to consolidate a number of personal items when a person is in a confined work or personal space. In these situations, personal space for personal items is dramatically reduced. Crowded offices include cubicles, guard houses, portable mobile units, shared office spaces, conference rooms adapted for multiple workers crowded together, etc. Examples of small living/working spaces include small apartments, dormitories, recreational vehicles, camping quarters, mobile units, and guard houses.

As an added desire, portability of a digital audio system is an important and desirable feature that is useful, in particular, for travel.

It is also desirable, to combine multiple separate devices that are used for a personal music player, a time clock, a weather display screen, a drink holder, an AM/FM radio, etc. to reduce the amount of space used.

It is additionally desirable that any such consolidated, compact device be able to perform well by utilizing a digital audio system so as to provide a high quality sound output.

BRIEF SUMMARY OF THE INVENTION

The embodied invention relates to an audio system-drink holder assembly, and, in particular, to an audio system-drink holder assembly where an audio system is an integral part of the assembly and provides a compact variety of audio features to a user. The drink holder is designed to take a variety of drink sizes and securely hold them in place as well as providing insulation for a hot (or cold) beverage temperature.

The embodied invention additionally includes an AM/FM radio with an embedded antenna, a music player, connection to an external Bluetooth device, speakers connected to a digital audio control system, a microphone for recording messages and providing control commands, a user interface for control and display, an electronic clock with alarm, a rechargeable battery supply pack with charging cord, and weather reporting.

BRIEF DESCRIPTION OF THE SEVERAL VIEWS OF THE DRAWING(S)

DETAILED DESCRIPTION OF THE INVENTION

Figure 1:
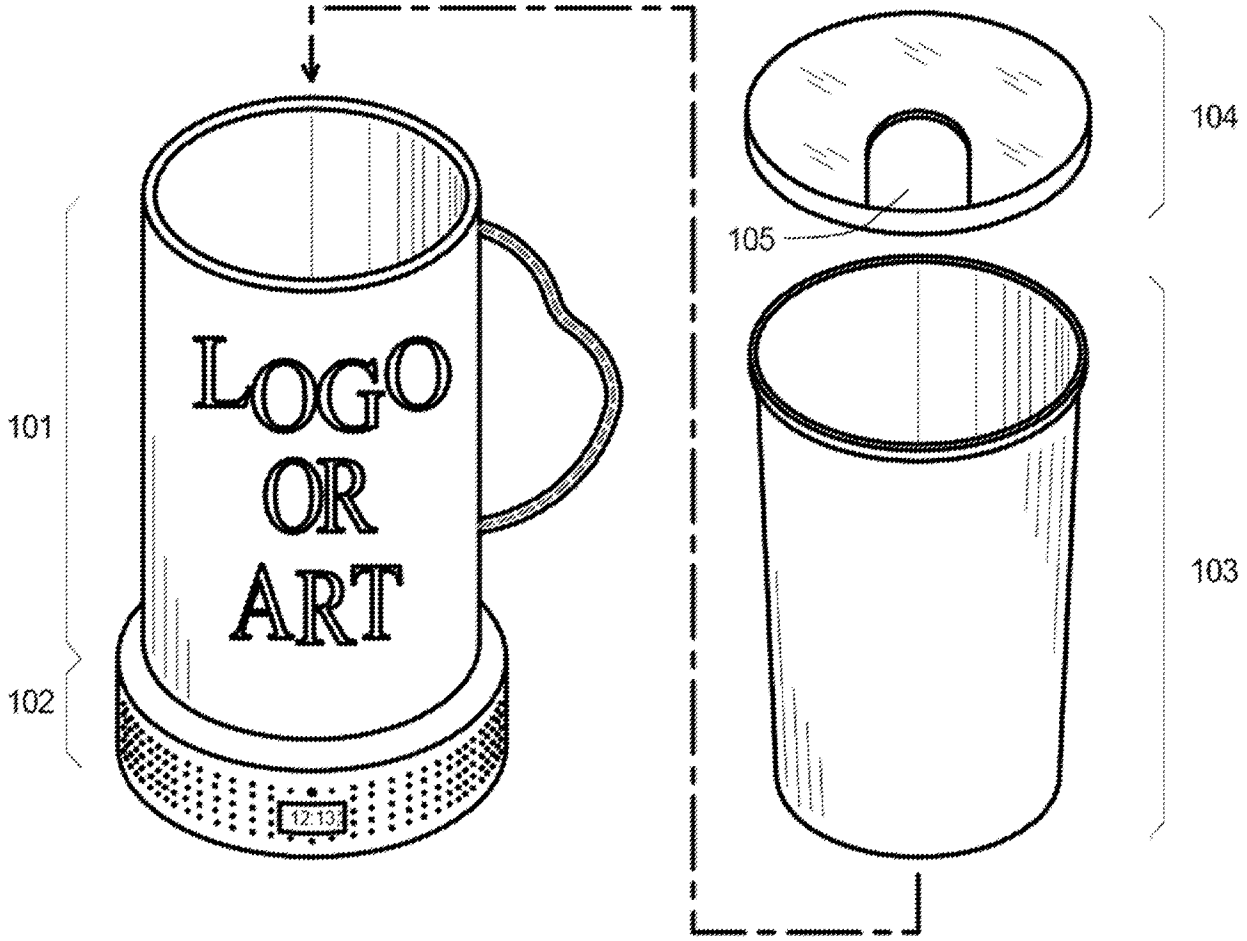
FIG. 1 is a perspective view of the invention showing a container holder, a beverage container, and a snap on lid.

Features included in the embodied invention include:

1. A display of an electric clock (digital) with alarm, and an AM/FM radio.
2. A beverage container holder that can hold a variety of drink containers such as coffee cups including Styrofoam coffee cups.
3. The beverage container holder preferably provides for a drink container to be inserted into the beverage container holder, with small lip from the beverage container to rest on an upper edge of the beverage container holder. Additionally, it is preferable to have a snap on lid for the beverage container.
4. The container holder has an integrated base, and both are made from waterproof plastic.
5. A radio (AM/FM) antenna is located inside the handle attached to the container holder.
6. The overall dimensions of the combination digital audio system and container holder includes a 1.5" tall by 5.5" circular base, an overall height of 9.5", and a 8" overall height×4.5"-5" diameter range cylindrical shaped beverage container holder.
7. A plurality of audio speakers in front, preferably located in the integral base.
8. The integral base includes a user interface with buttons and a LCD or LED screen display (only).
   a. A touch screen interface could equally be used, or in combination with buttons.
   b. A touch screen display is preferably located on the container holder, preferably in the back so that any art work or logo is visible on the front. The handle is preferably on the right side of the front as shown in FIG. 1, and is alternately located on the left side.

9. A USB connection (or other power supply) is used to charge re-chargeable battery.
10. A 3.5 mm aux jack is a combined input/output connection for headphones and connection to an inputting device.
11. Connectivity to another device such as a smart phone, tablet, electronic music player, or computer.
    a. The ability to receive voice commands and operate on them via a wireless connected device.
    b. The ability to play Bluetooth music from connected Bluetooth device.
    c. The ability to receive a phone call and talk on a speaker phone via a connected device.
    d. A built in microphone for recording to a non-volatile memory and voice commands.
    e. The ability to record a song or a voice recording to a Bluetooth attached device.
12. A digital audio control system FIG. 1 is a perspective view of the invention. A beverage holder 101 is connected to an integral base 102 that is rigidly attached to the beverage holder 101. An illustration of a preferred beverage container 103 with a snap on lid 104 is shown. The snap on lid has an optional drink opening 105 as illustrated.

Figure 2:
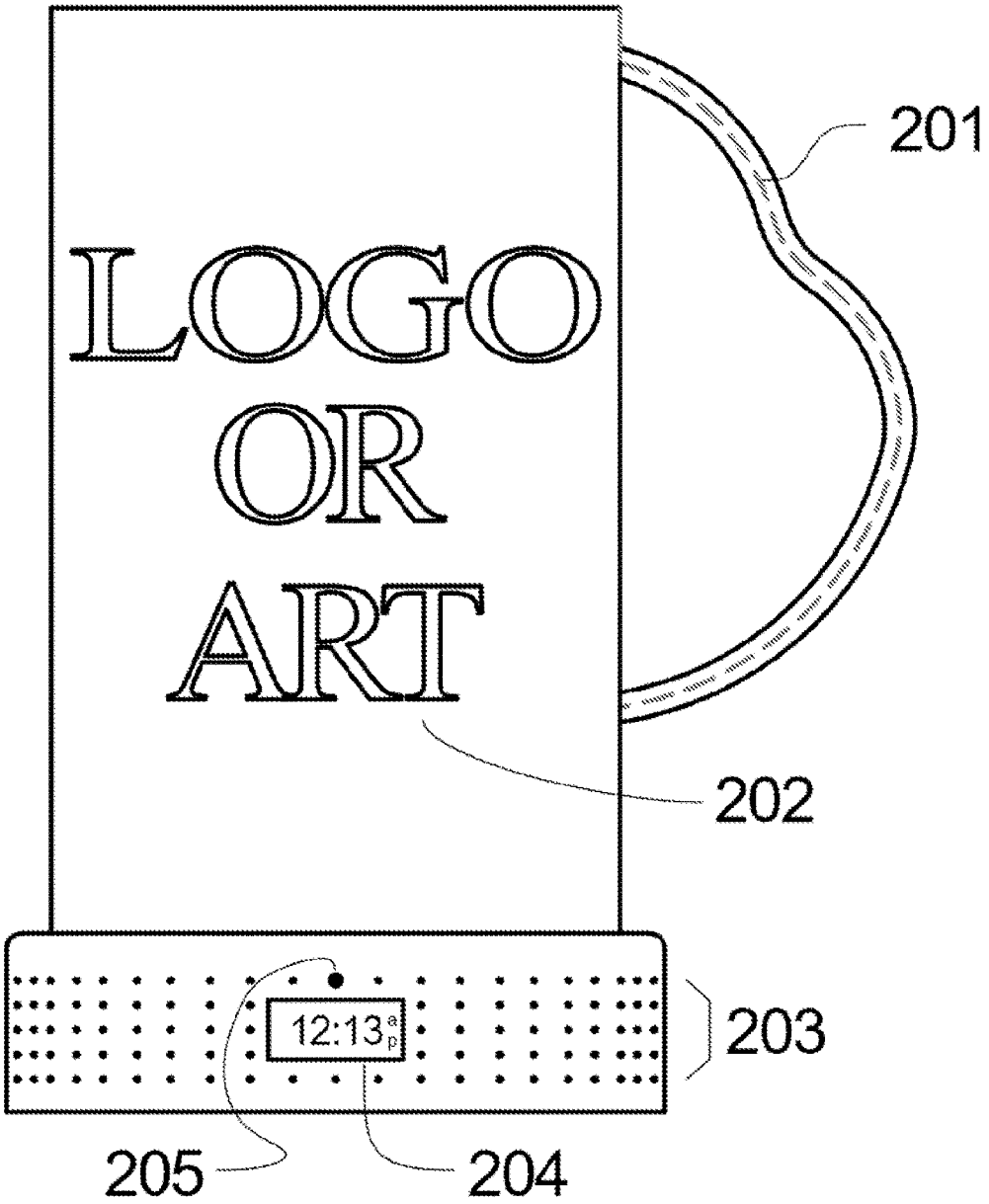
FIG. 2 is a front view of the invention.

FIG. 2 is a front view of the invention which shows a logo or art work display 202, an integral base 203 with an electronically controlled digital clock display 204, and an attached handle with an integrated antenna 201 that is used for radio reception (both AM and FM). Alternately an analog clock can be displayed. A light emitting diode (LED) light 205 is located in the integral base for convenience when the portable beverage holder is used in the dark. The LED light can be activated by pressing the LED light itself or by use of another switch (not shown).

Figure 3A:
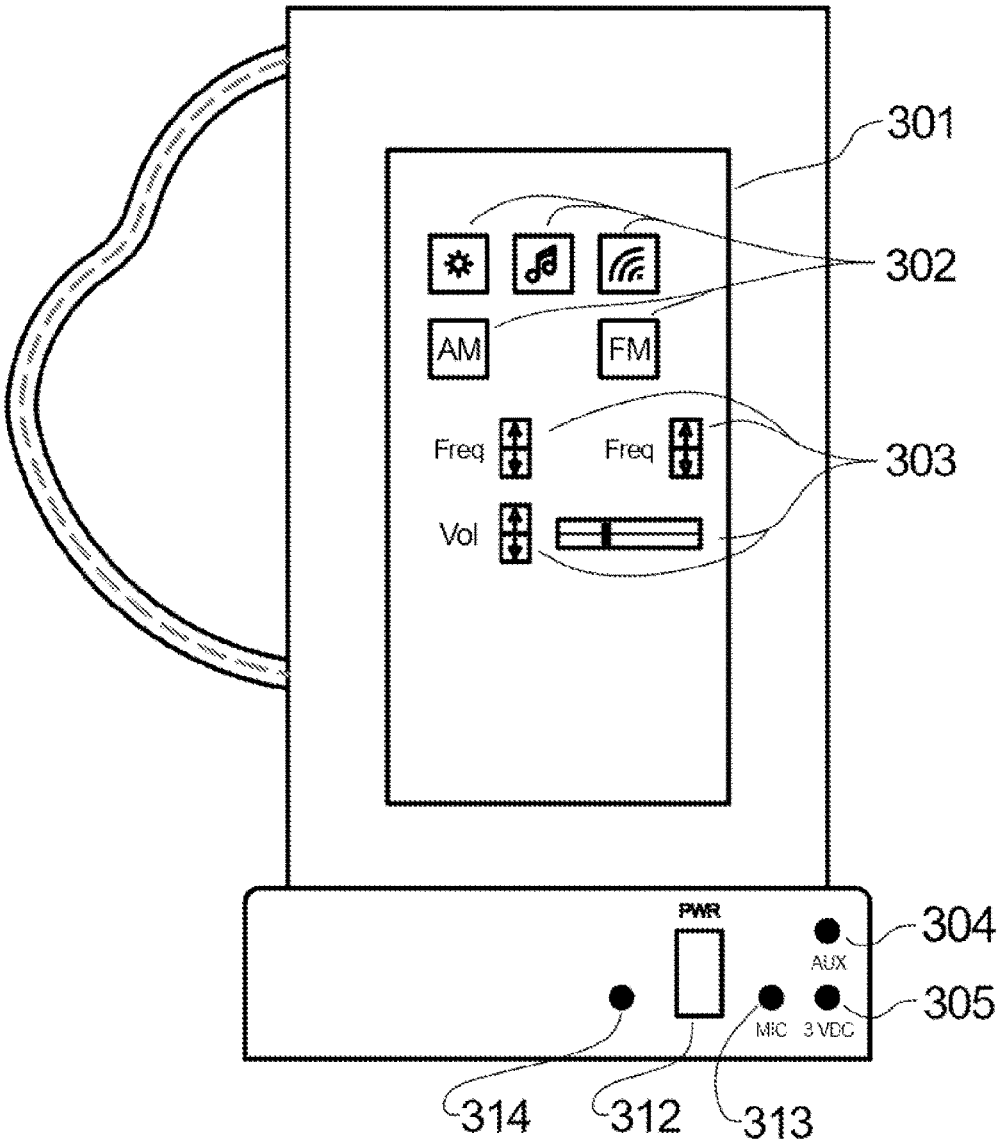
FIGS. 3A-3B is a back view of the embodied invention showing two options for a user interface.
Figure 3B:
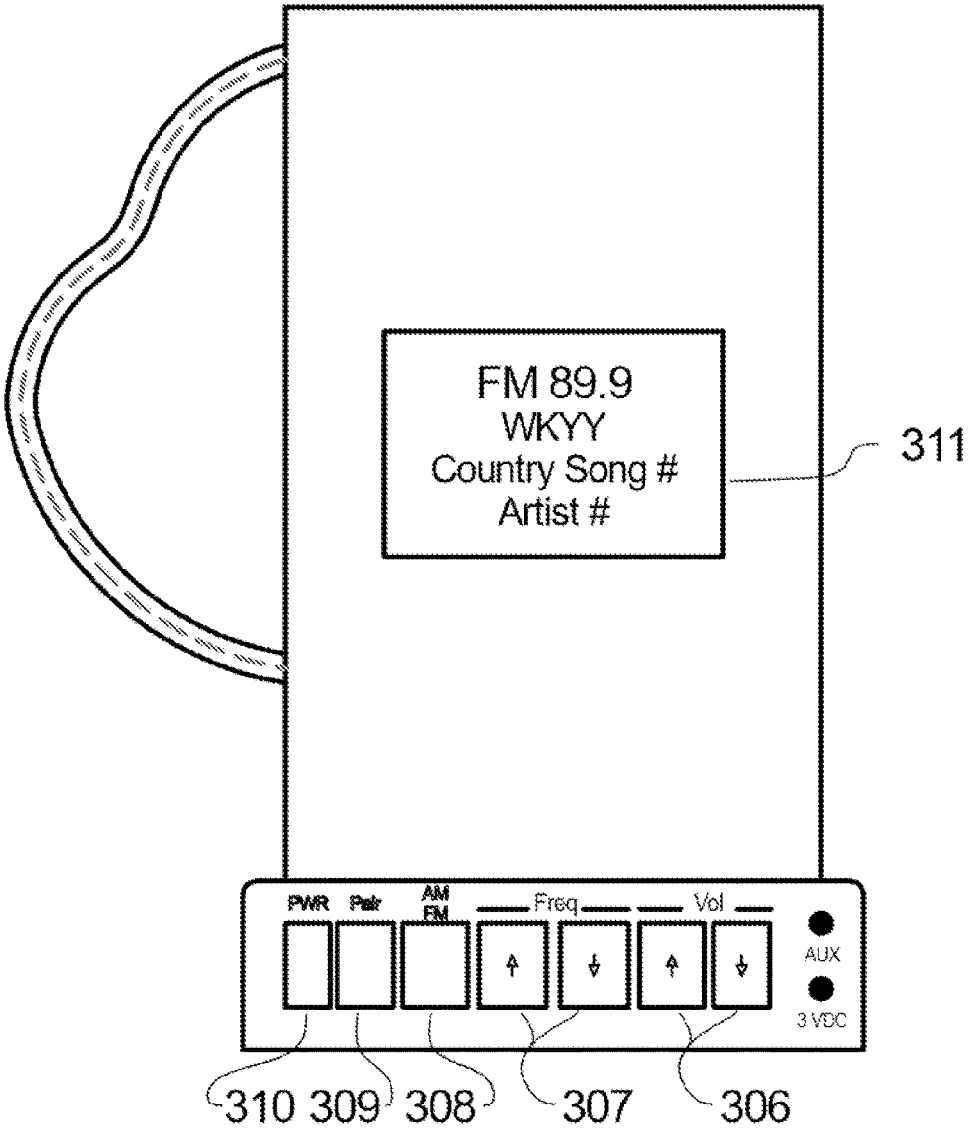

FIGS. 3A-3B is a back view of the embodied invention showing two options for the user interface.

In FIG. 3A, a touch screen interface 301 is provided where icons 302 are used to control the digital audio system features. For example, the icons can activate various features such as music play from an external device or from stored memory, and display important features such as the weather forecast. A Bluetooth or other wireless connection to other devices can be established. Radio control icons/touch buttons 303 are used to control the frequency tuning of the radio and the volume. An up/down method and a slider method of controlling the volume are shown. Other buttons can be used to accomplished these functions. An LED light 314 is also shown.

On the base of the unit, a power switch such as a power button 312 turns the digital audio system on. Also, a multiple use 3.5 mm auxiliary plug 304 is used to provide headphones, input from another device (such as an mp3 player), and connection to other devices. A power cord connection 305 is used to re-charge the batteries in the unit. A built in microphone 313 is used for recording messages and providing an interface for voice commands. The voice commands are preferably routed through an external connected device.

In FIG. 3B, the control of the unit is by use of buttons (or alternately, knobs) that control the radio volume 306, and frequency tuning 307. An AM/FM button 308 is used to switch between AM and FM frequencies. A pairing (Bluetooth) button 309 can be used to initiate paring of the device to an external wireless device such as a phone, tablet, computer, or network. A power button 310 is used to turn the unit off/on. An LED display 311 (or LCD, or similar) is used to display the status of the digital audio system and can display the radio frequency, the station, the song being played, and the artist if available.

Figure 4:
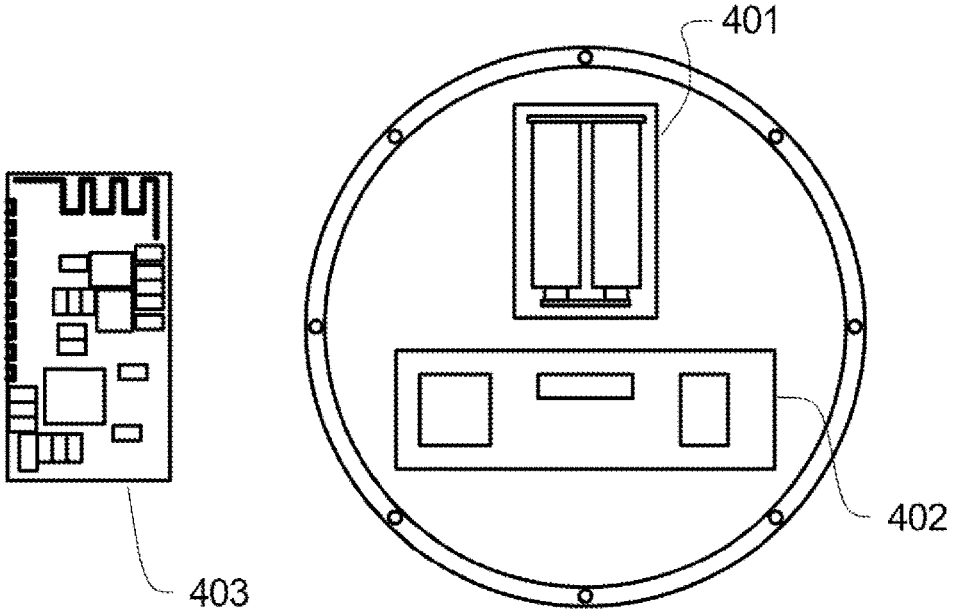
FIG. 4 is a view of the base bottom with the cover removed to show important control components of the embodied invention.

FIG. 4 is a view of the base bottom with the cover removed to show important components of the embodied invention. A battery supply pack 401 (preferably rechargeable batteries) is used to power the unit when not plugged into a power outlet. A control system located on at least one printed circuit board 402 is used to control all of the features of the unit. A single, integrated circuit board can provide for the control function, or alternately, additional control cards can be added to the unit such as a Bluetooth connectivity card 403 that has been removed. The digital audio control system will include a central processing unit, as well as volatile and non-volatile memory, and all signal connections to the various devices including the radio antenna. A simplified operating system can be used such as Linux to facilitate control for all of the features of the embodied invention. Any number of control circuit boards can be added, stacked, or arranged in the integral base. The printed circuit boards may incorporate a particular, or a plurality, of board communication and memory communication protocols including 10/100 BaseT Ethernet, HDMI, USB, SATA or FAT connection to a storage device, and Serial Peripheral Interface (SPI) bus. Other board and peripheral communication protocols could equally be used.

Figure 5A:
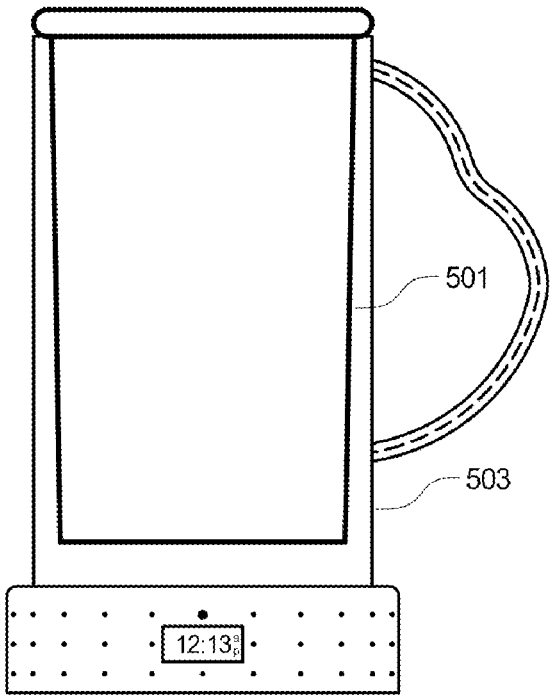
FIGS. 5A-5B show a beverage container, a snap on lid, and the container holder of the embodied invention.
Figure 5B:
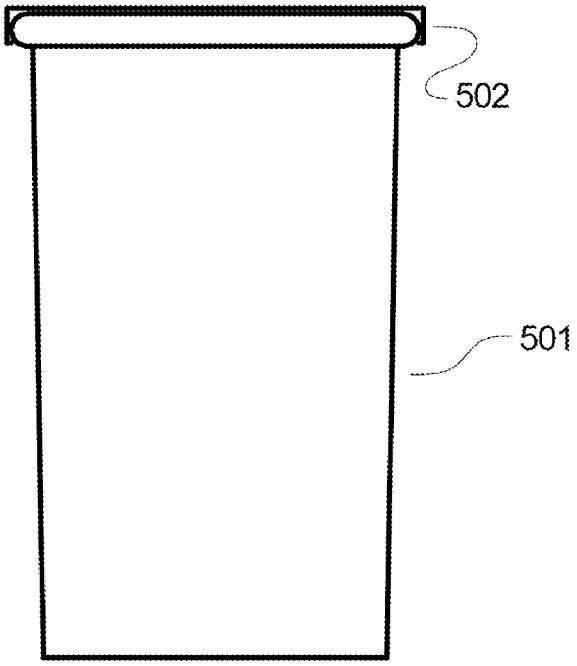

FIGS. 5A-5B show a beverage container 501, a snap on lid 502, and the container holder 503 of the embodied invention.

Figure 6:
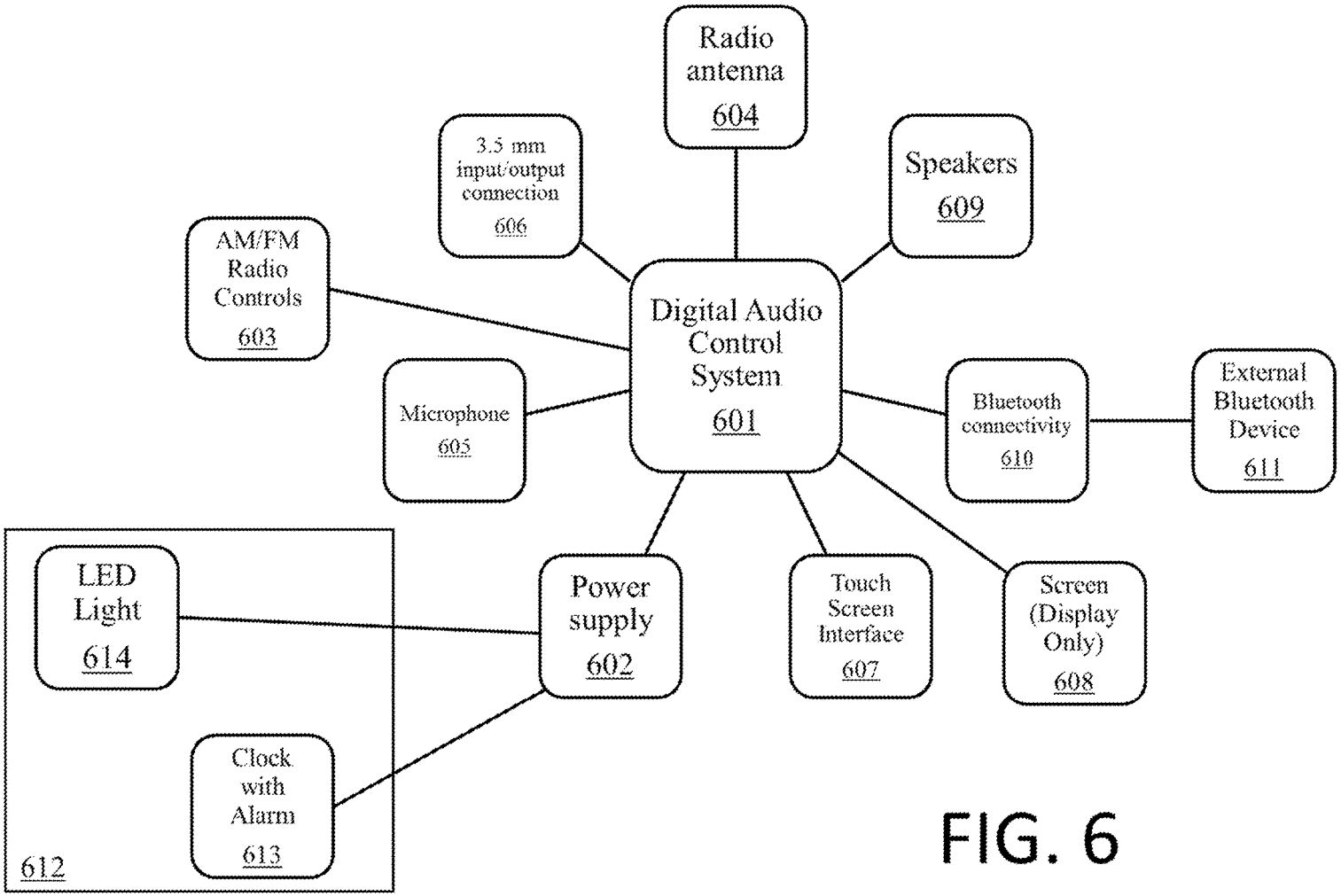
FIG. 6 shows an overview of the digital audio control system.

FIG. 6 shows an overview of the digital audio control system 601. A power supply 602 provides power for the digital audio control system 601, and also external devices 612 that are not controlled by the digital audio control system comprising an LED light 614 and a digital clock with alarm 613. An FM/AM radio antenna 604 is directly connected to the digital audio control system. Audio from the AM/FM radio can be recorded to a non-volatile memory located on the printed circuit board(s) through the digital audio control system. Additionally connected to the digital audio control system include speakers 609, a Bluetooth connectivity interface 610, a touch screen interface 607 if used, a microphone 605, a 3.5 mm input/output connection 606, a display only Screen 608 if used, and AM/FM radio controls 603. An external Bluetooth device 611 is connected to the Digital audio control system through the Bluetooth connectivity interface. The Bluetooth connectivity interface is alternately incorporated onto the same printed circuit board as the digital audio control system. The external Bluetooth device can be any of a mobile phone, a tablet, an electronic music player, or a computer.

While various embodiments of the present invention have been described, the invention may be modified and adapted to various operational methods to those skilled in the art. Therefore, this invention is not limited to the description and figure shown herein, and includes all such embodiments, changes, and modifications that are encompassed by the scope of the claims.

I claim:

1. A digital audio system integrated with a beverage container holder assembly comprising:
    A. a container holder, wherein said container holder is substantially cylindrical in shape with an open top and a bottom wall,
    B. wherein said container holder is designed to hold a beverage container,
    C. wherein said container holder is made from waterproof plastic, D. an integral base rigidly attached to said container holder, E. a rechargeable battery supply located within said integral base that is used to power said digital audio system, F. a plurality of audio speakers located within said integral base, G. a digital audio control system located within said integral base that controls said digital audio system, H. the following items located inside said integral base:

1. said digital audio control system located on at least one printed circuit board,
2. a microphone for recording and receiving voice commands,
3. Bluetooth connectivity to an external Bluetooth device, wherein said Bluetooth connectivity incorporates the following functions comprising:
   a. playing audio on said audio speakers from said external Bluetooth device, and
   b. providing connectivity to said external Bluetooth device for phone call responses,
4. a power cord connection,
5. 3.5 mm jack connection useful for input or output, and
6. a power switch, I. a user interface comprising at least one item from the group consisting of:

1. buttons,
2. knobs,
3. screen display,
4. a touch screen display that receives touch commands from a user who operates said digital audio system, and
5. time display, J. an AM/FM radio, K. electronically controlled clock with an alarm, L. a radio antenna located within a handle connected to said container holder, and M. wherein said radio antenna is connected to said at least one printed circuit board.

2. The digital audio system according to claim 1 wherein said beverage container is a Styrofoam coffee cup.

3. The digital audio system according to claim 2 wherein said beverage container incorporates a snap on lid with a drink opening.

4. The digital audio system according to claim 1 wherein said touch screen display is located on said container holder.

5. The digital audio system according to claim 1 wherein said screen display is located on said container holder.

6. The digital audio system according to claim 1 wherein said external Bluetooth device comprises a mobile phone, a tablet, an electronic music player, or computer.

7. The digital audio system according to claim 1 wherein said integral base incorporates a LED light.

8. The digital audio system according to claim 1 wherein said digital audio control system is designed to record audio from said AM/FM radio to a non-volatile memory.

* * * * *